US006705484B2

(12) United States Patent
Schäfer

(10) Patent No.: US 6,705,484 B2
(45) Date of Patent: Mar. 16, 2004

(54) PLASTIC TRANSPORT CONTAINER WITH REINFORCED FLOOR

(75) Inventor: Gerhard Schäfer, Neunkirchen (DE)

(73) Assignee: Fritz Schafer GmbH, Neunkirchen (DE)

( * ) Notice: Subject to any disclaimer, the term of this patent is extended or adjusted under 35 U.S.C. 154(b) by 0 days.

(21) Appl. No.: 10/167,745

(22) Filed: Jun. 12, 2002

(65) Prior Publication Data

US 2002/0195454 A1 Dec. 26, 2002

(30) Foreign Application Priority Data

Jun. 20, 2001 (DE) ..... 201 10 191 U

(51) Int. Cl.[7] ..... B65D 1/42
(52) U.S. Cl. ..... 220/628; 220/635; 220/DIG. 15
(58) Field of Search ..... 220/1.5, 500, 516, 220/523, 600, 604, 608, 613, 626, 627, 635, 509, 675, 628, DIG. 15; 108/57.17, 56.1, 57.28

(56) References Cited

U.S. PATENT DOCUMENTS 3,506,154 A * 4/1970 Barnes ..... 220/645
3,643,993 A * 2/1972 Asadurian ..... 294/68.26
4,597,503 A * 7/1986 Lates ..... 220/676
5,551,594 A * 9/1996 Schafer ..... 220/675
6,467,646 B2 * 10/2002 Schafer ..... 220/600

FOREIGN PATENT DOCUMENTS

| | | |
|---|---|---|
| DE | 39 09 022 | 9/1990 |
| DE | 43 38 063 | 5/1995 |
| DE | 295 00 765 | * 6/1995 |
| DE | 196 27 887 | * 1/1998 |
| DE | 200 06 767 | * 9/2000 |
| EP | 041307 | * 12/1981 |
| GB | 2255968 | * 11/1992 |

* cited by examiner

*Primary Examiner*—Lee Young
*Assistant Examiner*—Joseph C. Merek
(74) *Attorney, Agent, or Firm*—Herbert Dubno; Andrew Wilford

(57) ABSTRACT

A container has a polygonal and generally planar floor panel having a plurality of edges, an upper face, and a lower face. Respective side walls extend upward from the edges of the floor panel and a plurality of ribs extend downward from the lower face of the floor panel adjacent the edge. An annular floor strip fixed to the ribs forms therewith an annular array of pockets having horizontally outwardly open mouths. In accordance with the invention closure strips engaged over the mouths horizontally close the pockets and are fixed permanently to the mouths of the pockets. The floor panel, side walls, ribs, and floor strip are unitarily formed of plastic.

10 Claims, 11 Drawing Sheets

PLASTIC TRANSPORT CONTAINER WITH REINFORCED FLOOR

FIELD OF THE INVENTION

The present invention relates to a plastic container. More particularly this invention concerns such a container, crate, or box used for storage and transport.

BACKGROUND OF THE INVENTION

A standard container used for storing and shipping freight is formed of molded plastic with a rectangular floor panel from whose edges side walls extend upward. A plurality of ribs extend downward from a lower face of the floor panel adjacent the edge and a floor strip parallel to the floor panel is fixed to the ribs and forms therewith an annular array of pockets having horizontally open mouths. Such a container, as described in German patent documents 3,909,022 of K. Korte and 4,338,063 is relatively robust. The flat floor strip ensures good surface contact with any supporting surface, making it particularly easy to handle this type of container with a roller conveyor.

The open box-like pockets formed between the floor panel and the underlying floor strip impart considerable rigidity and strength to the container. They are produced during manufacture of the container in a movable-part mold. In use, however, they tend to trap foreign matter, both solid and liquid. This makes the containers problematic when used with, for instance, foodstuffs as it is difficult or impossible to clean them thoroughly.

OBJECTS OF THE INVENTION

It is therefore an object of the present invention to provide an improved container.

Another object is the provision of such an improved molded plastic container which overcomes the above-given disadvantages, that is which is very rigid but easy to maintain clean.

SUMMARY OF THE INVENTION

A container has according to the invention a polygonal and generally planar upper or main floor panel having a plurality of edges, an upper face, and a lower face. Respective side walls extend upward from the edges of the floor panel and a plurality of ribs extend downward from the lower face of the floor panel adjacent the edge. An annular floor strip fixed to the ribs below the main floor panel forms with the main floor panel and the ribs an annular array of pockets having horizontally outwardly open mouths. In accordance with the invention, closure strips engaged over the mouths horizontally close the pockets and are fixed permanently to the mouths of the pockets.

Thus the structural advantages of these pockets, that is the rigidity, are retained, but the disadvantage, that is the dirt trapping, is eliminated. The containers according to the invention therefore have all the advantages of the prior art but none of the disadvantages. What is more, closing the outer ends of the pockets, whose inner ends are closed by an annular inner rib, greatly increases the rigidity of the floor panel, making the container according to the invention much stronger than the prior-art containers and capable of carrying substantially greater loads. Crushing of the floor panel and floor strip together is virtually impossible.

The floor panel, side walls, ribs, and floor strip according to the invention are unitarily formed of plastic. Furthermore the closure strips are unitarily formed of plastic with the floor panel, side walls, ribs, and floor strip and are joined to the floor strip by a unitary hinge so they can pivot between a closed position engaged over the respective mouths and closing same and an open position. The container is molded with the closure strips in the open position and, after separation from the mold, the closure strips are pivoted into the closed position where they are permanently fixed.

In accordance with the invention, strips are provided with barbed fasteners engageable in the pockets to hold them in place. Alternately welds between the closure strips and the mouths of the pockets secure them together. The mouths have planar rims that fit flush with the closure strips and where the welds are formed. These rims can be formed according to the invention with weld-holding grooves.

To facilitate sliding of the containers, either on a roller conveyor or up onto the tines of a fork lift, the closure strips and the floor strips meet at an outer edge that is rounded or beveled. Similarly the ribs can include an annular inner rib inwardly closing the pockets and meeting the floor strips at an inner edge that is beveled or rounded.

According to another feature of the invention, a central lower floor panel spaced below the upper or main floor panel within the floor strip has an outer edge joined to and unitary with the floor strip. This lower floor panel can have an upwardly recessed central portion. There is a normally vertical central rib fixed to the upper floor panel and to the lower floor panel.

The upper floor panel and lower floor panel are formed with vertically throughgoing drain holes. These are provided in the ribs so that any liquid trapped in the container will drain right through the floor panel and out.

A bridge strip parallel to the floor strip and supported by the ribs extends across an inner periphery of the floor strip spaced below the upper floor panel. This bridge strip forms with the respective ribs a horizontal passage and the container is formed in the passage with a blocking partition. The bridge strip is offset from the floor strip toward the floor panel.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 4A is a large-scale view of the detail indicated at IVA in FIG. 4;

SPECIFIC DESCRIPTION

Figure 1:
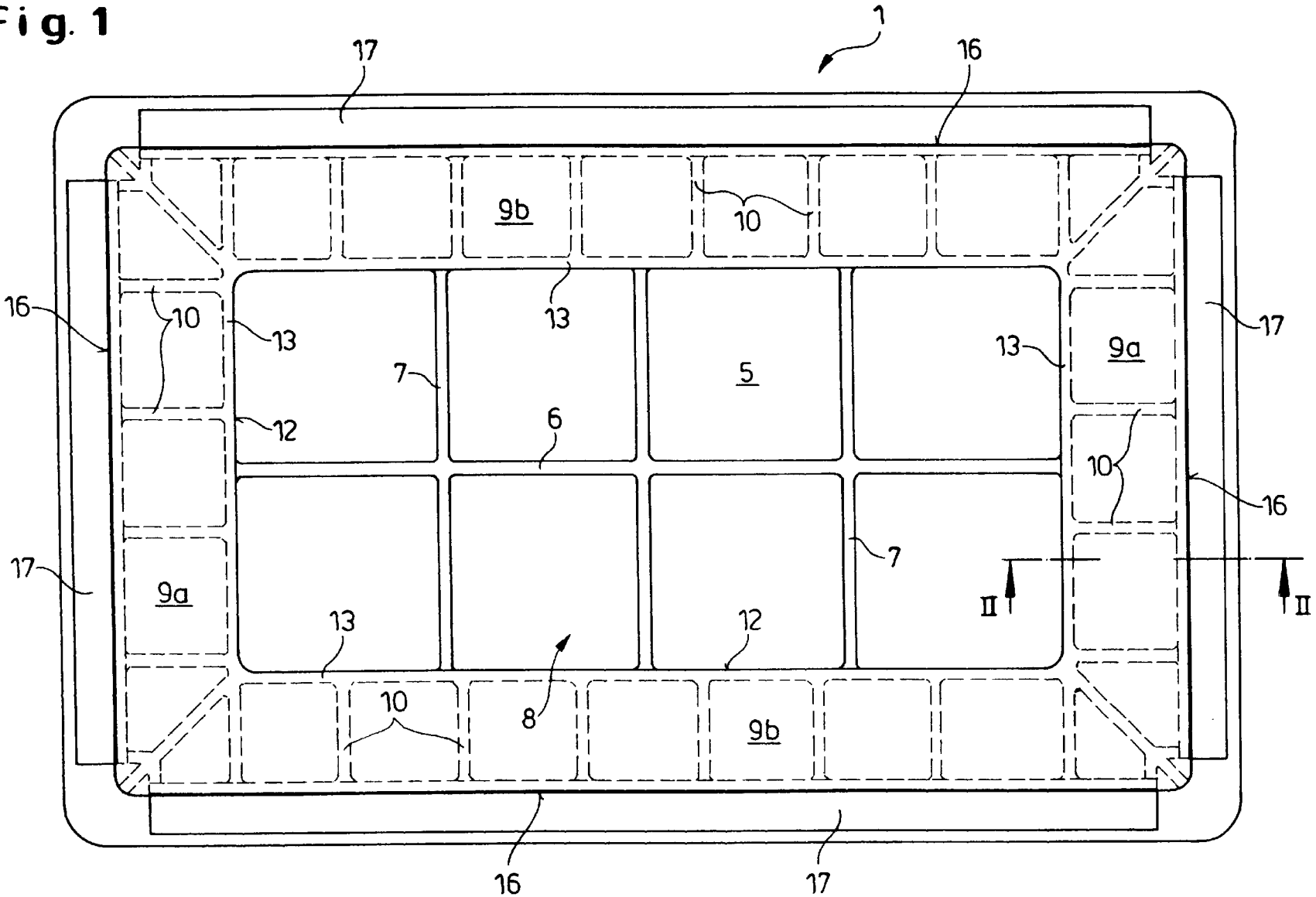
FIG. 1 is a bottom view of a container according to the invention.

As seen in FIGS. 1, 2, 3, 4, and 4A a molded plastic container or box 1 according to the invention has a planar and rectangular floor panel 5 having an upper face 4 and a lower face 11 and from whose transverse edges rise side walls 2 bridged by side walls 3 running along the longitudinal edges to form an upwardly open and downwardly and horizontally closed space, although of course this container 1 could be used in any desired orientation with respect to the vertical. Longitudinal ribs 6 and transverse ribs 7 project downward from the lower surface 11 of the floor panel 5 in a rectangular central region 8. Flanking this central region 8 are transverse floor strips 9*a* and longitudinal floor strips 9*b* together forming a generally planar rectangular annulus supported by an annular inner rib 13 bounding the region 8 and a plurality of spaced ribs 10 extending crosswise of the respective floor strips 9*a* and 9*b*, the ribs 10 and 13 being vertical and perpendicular to the parallel floor panel 5 and floor strips 9*a* and 9*b*. Thus the floor strips 9*a* and 9*b* form with the outer edge region of the floor panel 5, the inner rib 12, and the ribs 10 an array of pockets 14 having outwardly horizontally open mouths 15. This structure is all generally standard.

Figure 2:
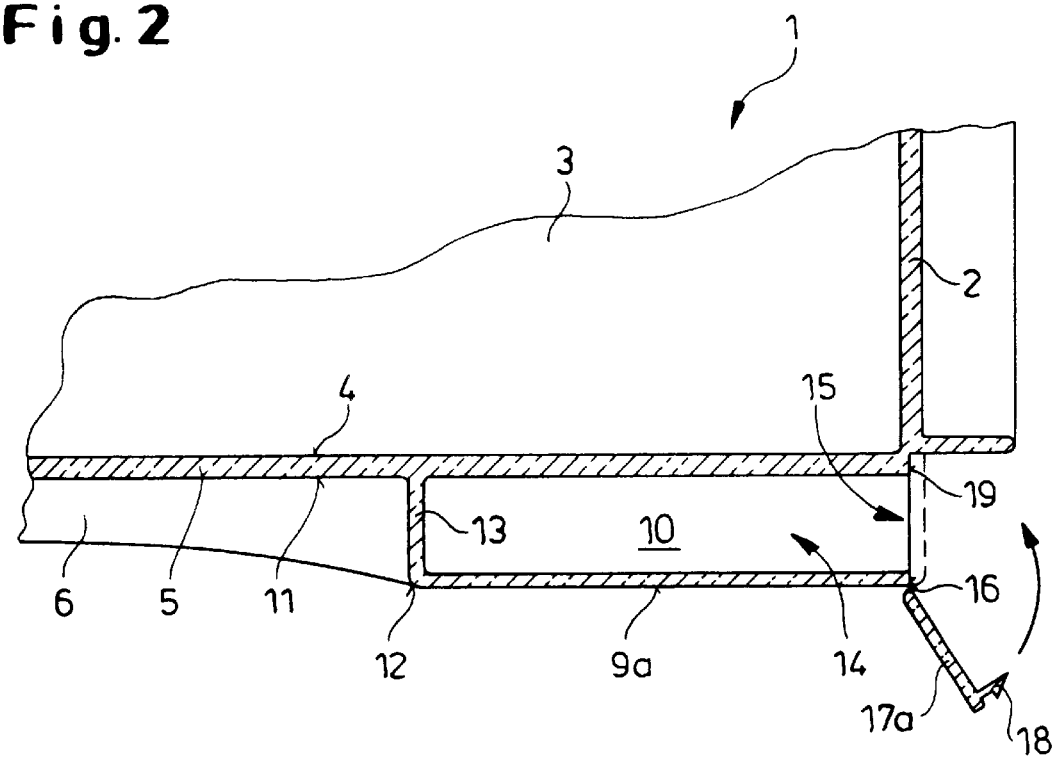
FIGS. 2, 3, and 4 are sections corresponding to line II—II of FIG. 1 showing alternative structures.
Figure 3:
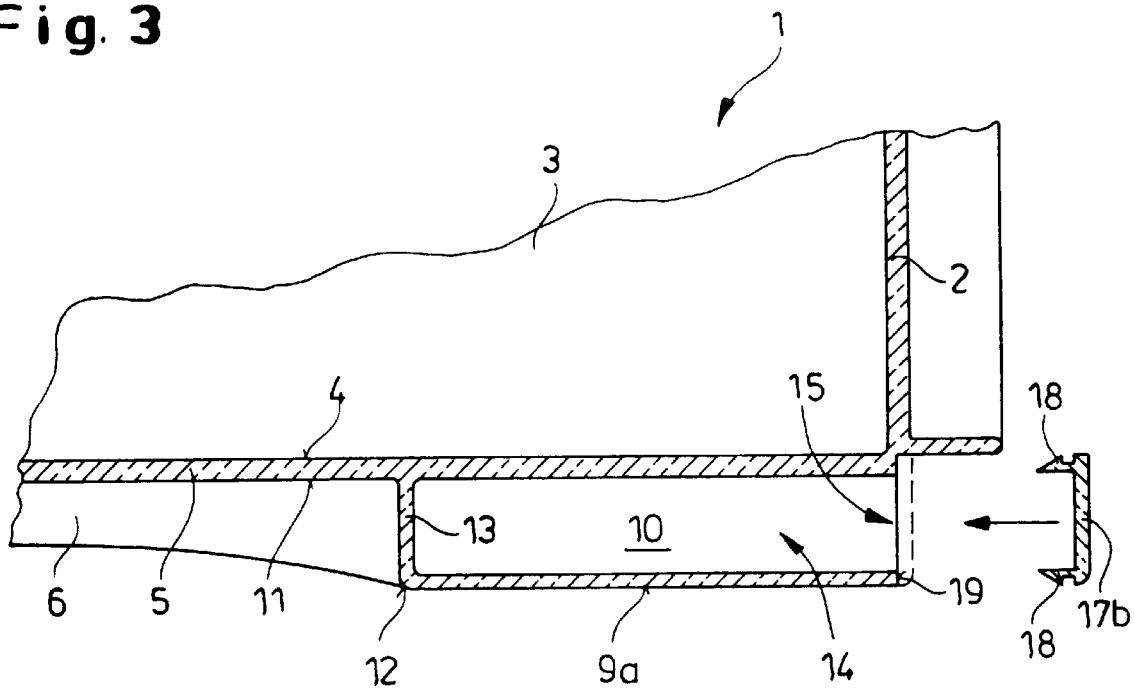

In accordance with the invention closure strips 17 (FIGS. 1, 4, and 4A), 17*a* (FIG. 2), or 17*b* (FIG. 3) can be fitted over these mouths 15 to close them, engaging flatly against a planar annular rim 19 formed around each pocket 14 at the respective mouth 15. The closure strip 17*a* shown in FIG. 2 is permanently fixed to the strip 9*a* by an integral plastic hinge 16 and is formed with a single barbed projection 18 so that it can be pivoted up as indicated by the arrow to fit against and permanently close the respective mouth 15. In FIG. 3 the strip 17*b* is a separate part formed with two of the barbs 18 and insertable in a straight line as shown by the arrow.

Figure 4:
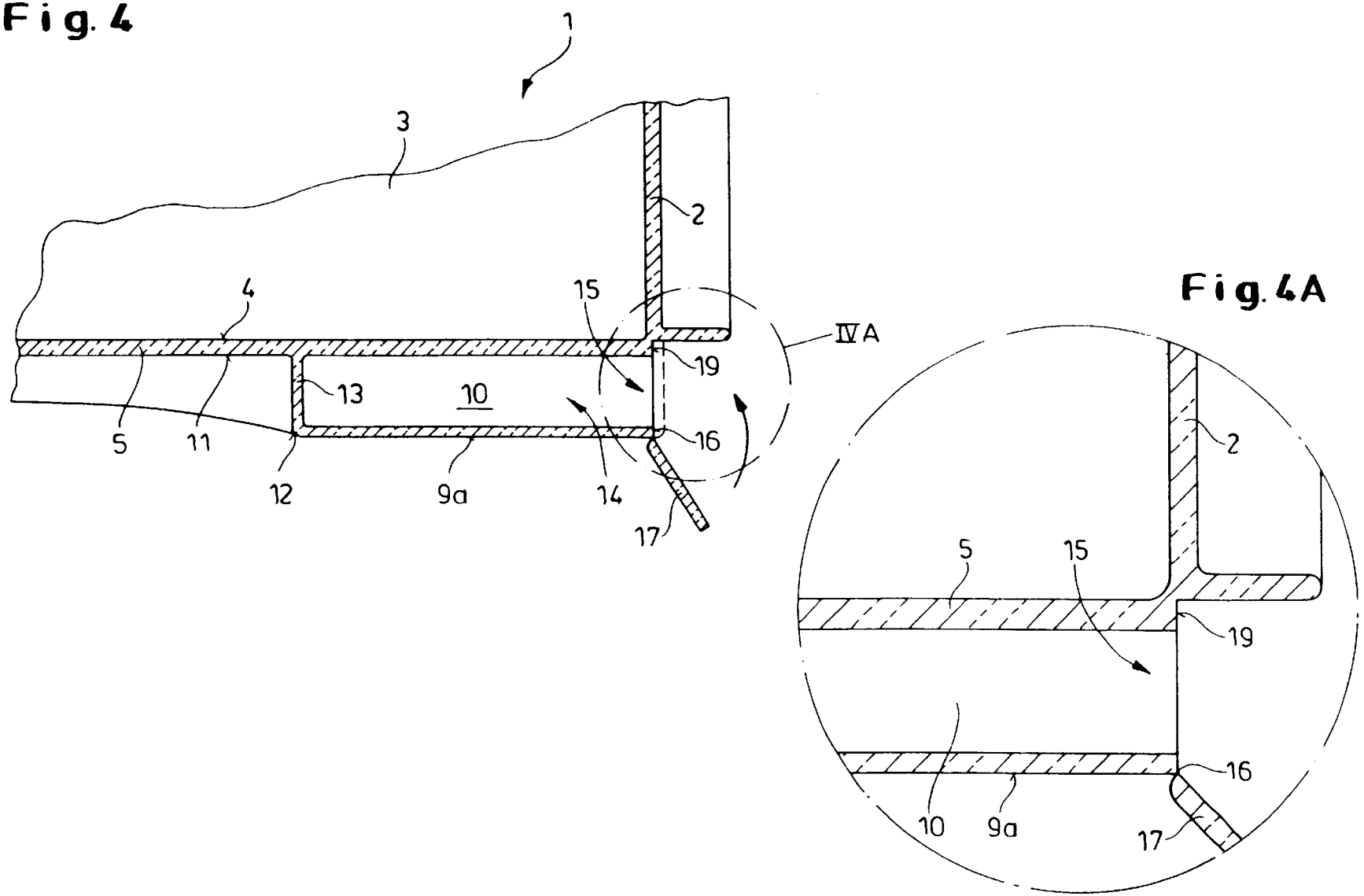
Figure 5A:
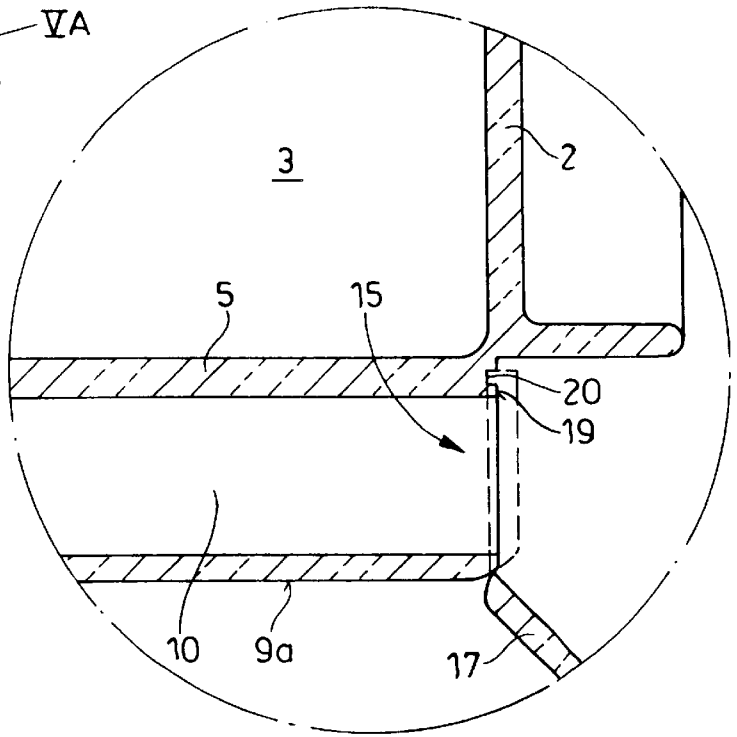
FIG. 5A is a large-scale view of the detail indicated at VA in FIG. 5.
Figure 5:
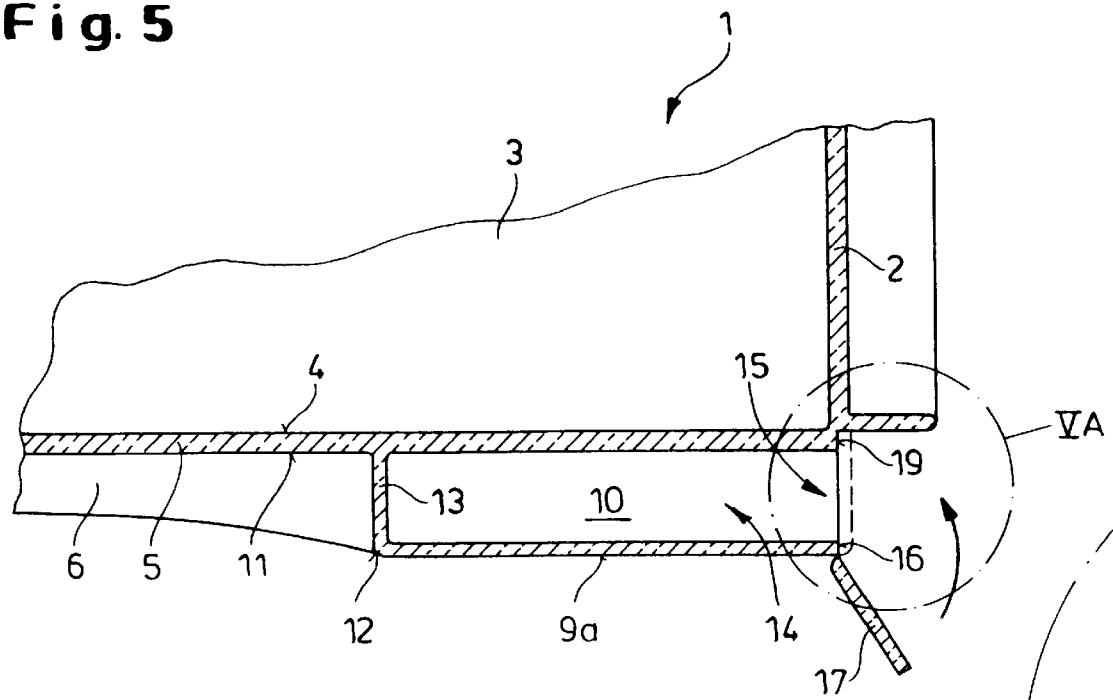
FIG. 5 is a section line FIG. 2 of another container in accordance with the invention.
Figure 6:
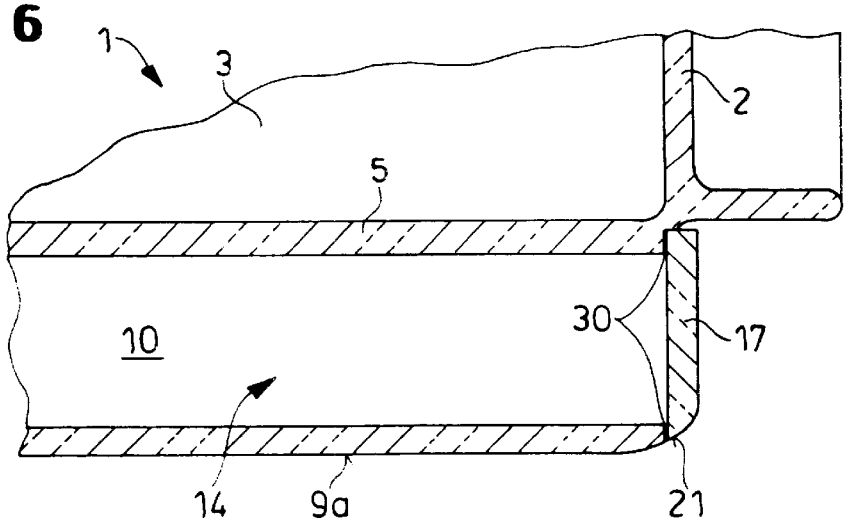
FIGS. 6, 7, and 8 are sections like FIG. 2 of further embodiments of the invention.
Figure 7:
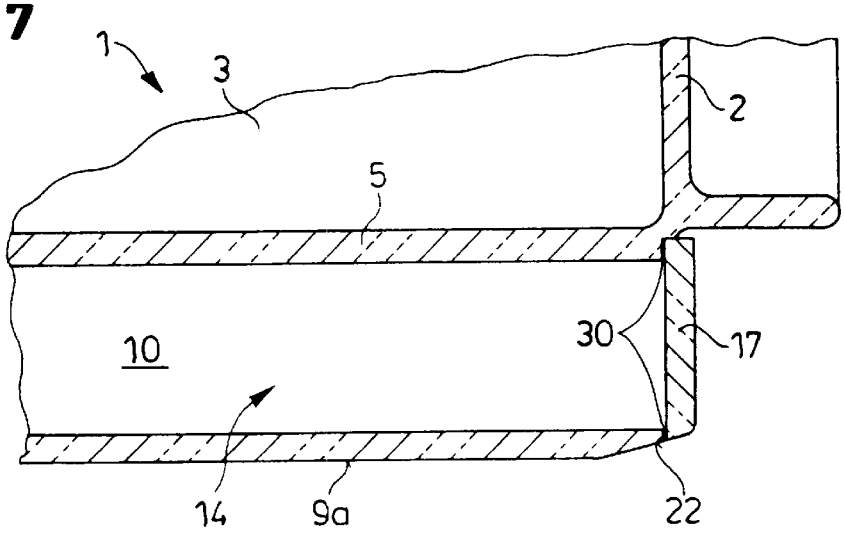
Figure 8:
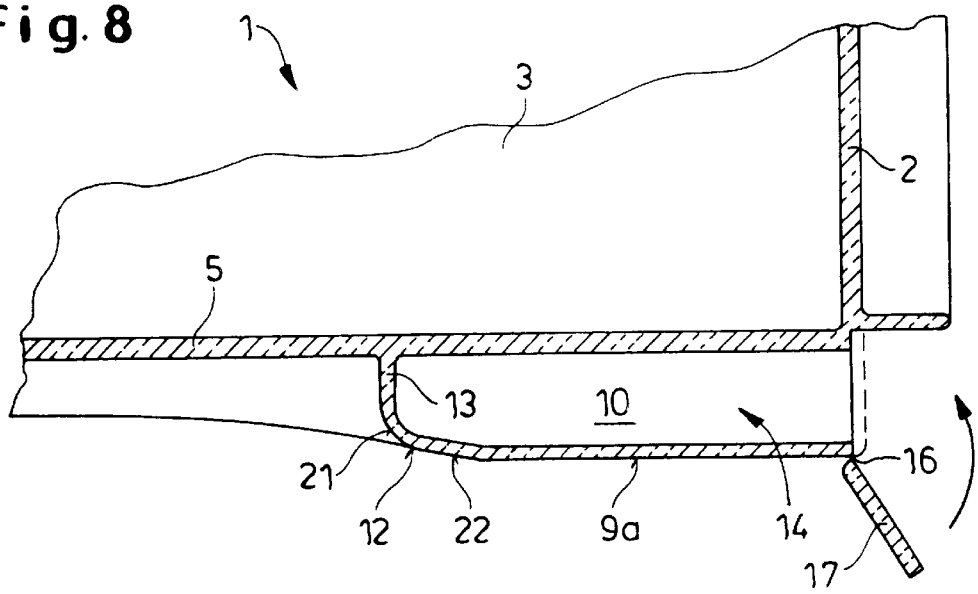
Figure 9:
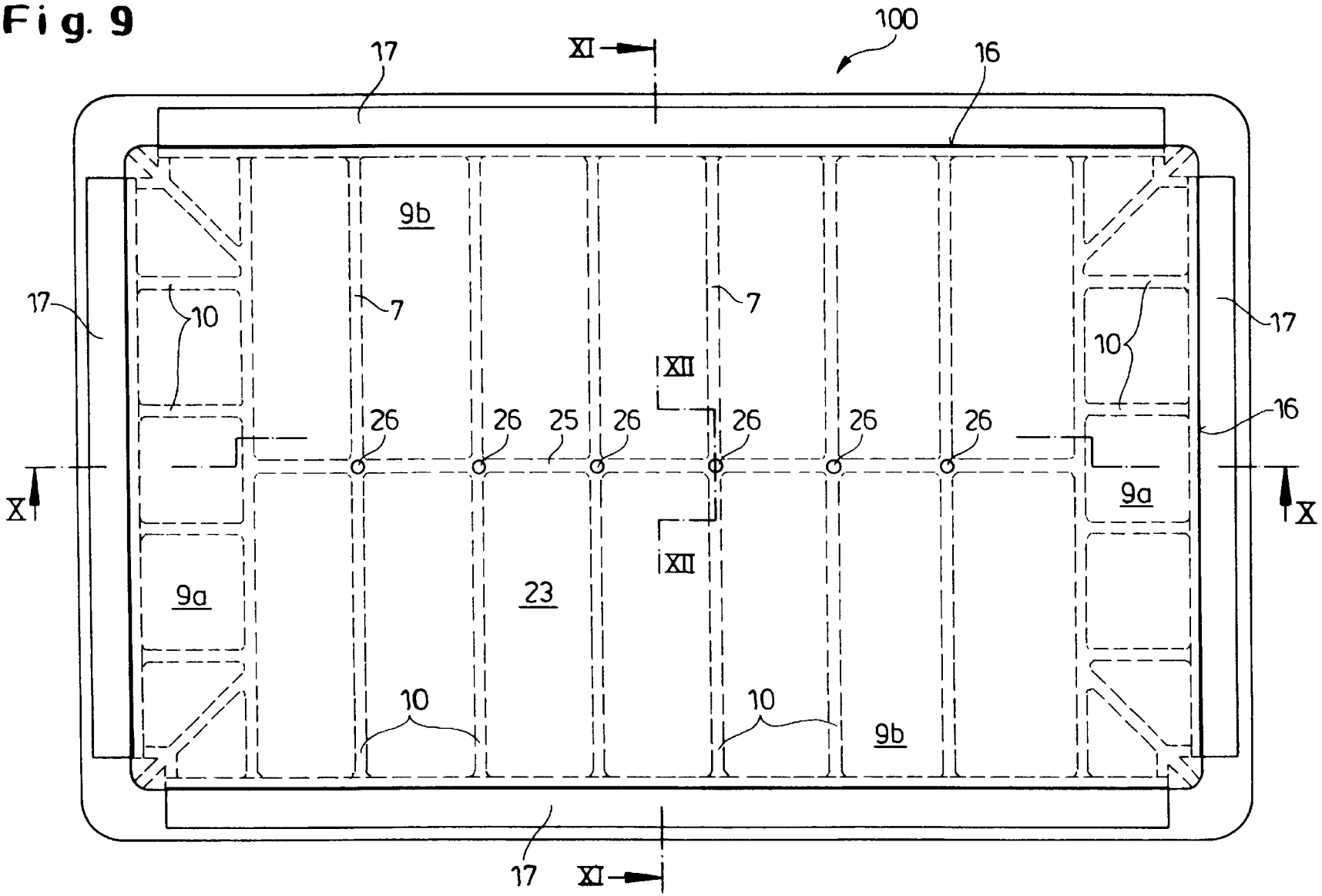
FIG. 9 is a bottom view of another container in accordance with the invention.
Figure 10:
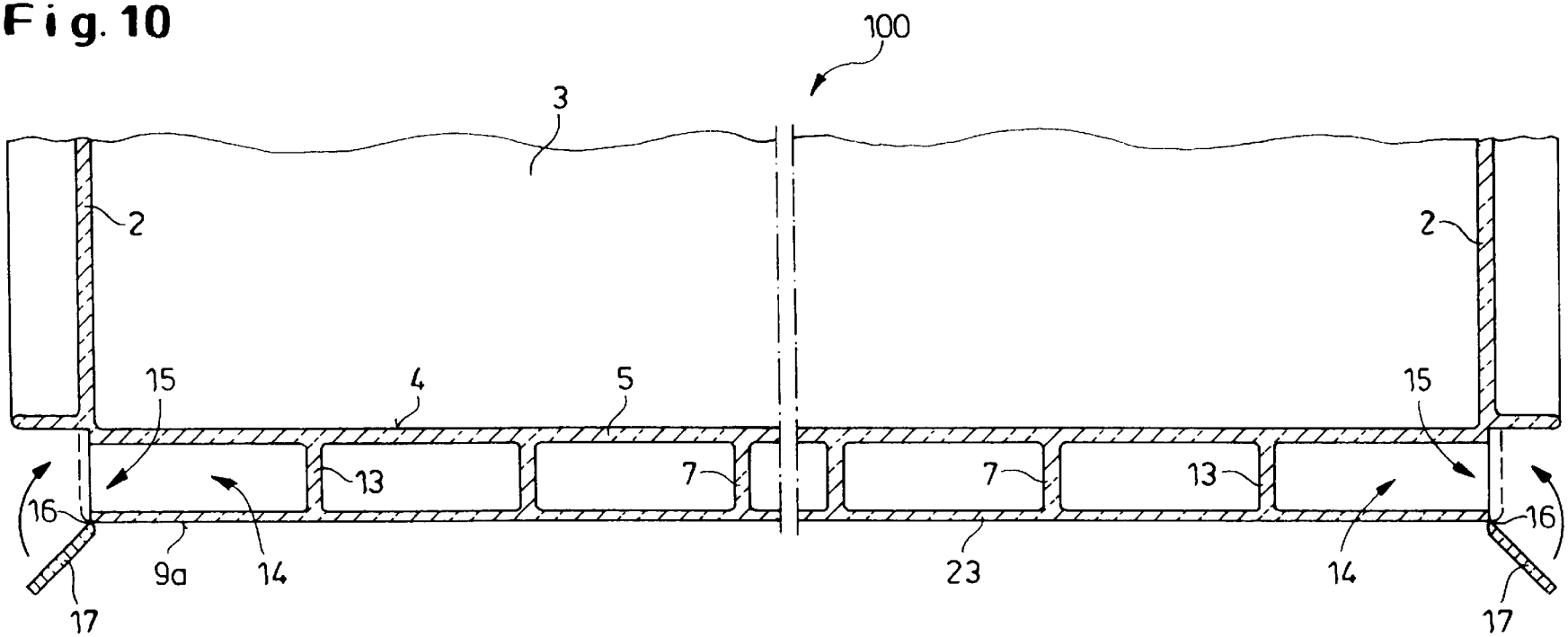
FIG. 10 is a section taken along line X—X of FIG. 9.

The system of FIGS. 5 and 5A has a pivoted closure strip or flap like that of FIGS. 1, 4, and 4A but the planar rim 19 is formed with a groove 20 adapted to hold an adhesive or weld material. This strip 17 is shown in the closed position in FIGS. 6 and 7 with weld material 30 between it and the rim 19. In FIG. 6 the lower outer edge where the strip 17 meets the strip 9*a* is rounded at 21 and in FIG. 7 it is beveled at 22 so as to facilitate sliding of the container or picking it up with a fork lift. In FIG. 8 an inner corner 12 where the strip 9*a* meets the rib 13 is formed with both a rounding 21 and a bevel 22.

The container 100 of FIGS. 9, 10, 11, and 12, where reference numerals from FIGS. 1 through 8 are used for functionally identical structure, has a central lower floor panel 23 coplanar with and within the annular floor strips 9*a* and 9*b* and spaced below the upper floor panel 5. It is supported on the transverse ribs 7 and a single central longitudinal rib 25 and vertically throughgoing drain holes or passages 26 are formed at the intersections of the ribs 7 and 25 as shown in FIG. 12. The center partition rib 25 takes the place of the inner rib 13, in effect making the pockets 14 much deeper.

Figure 11:
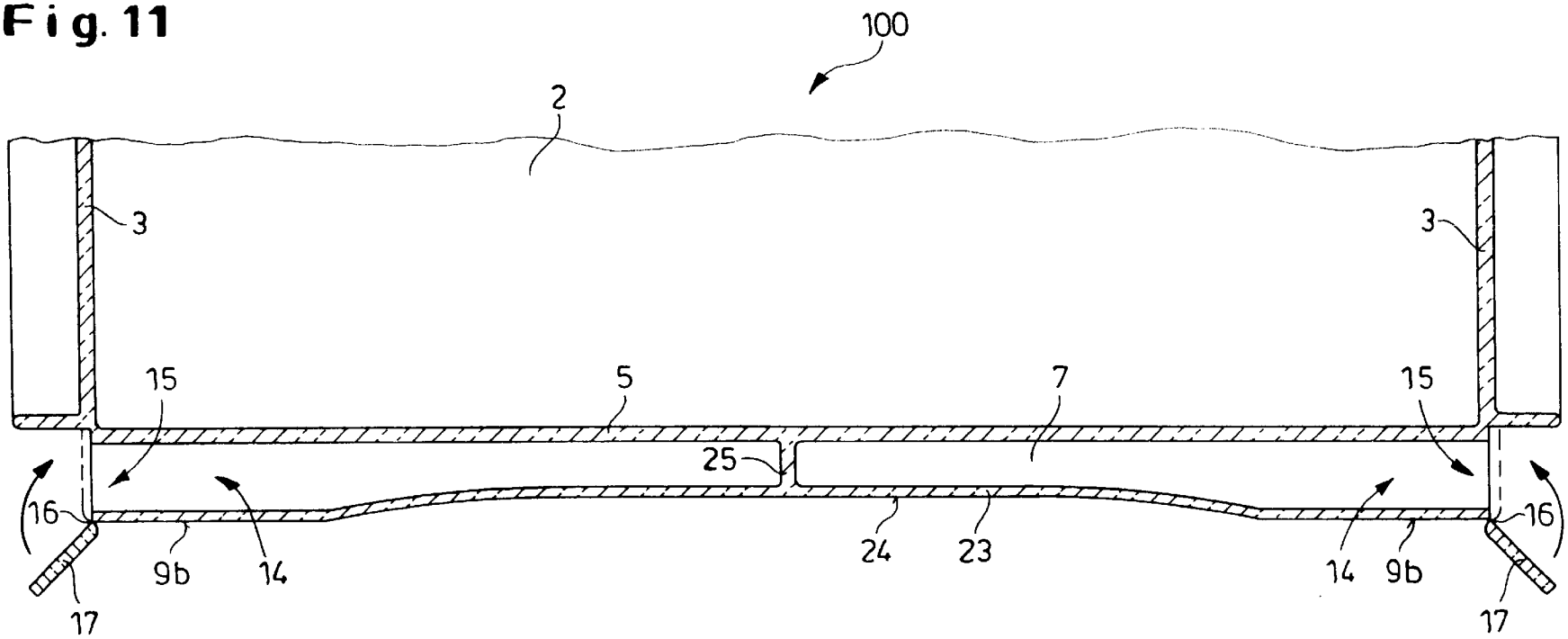
FIG. 11 is a section like FIG. 10 shown a variation on the container of FIG. 9.
Figure 12:
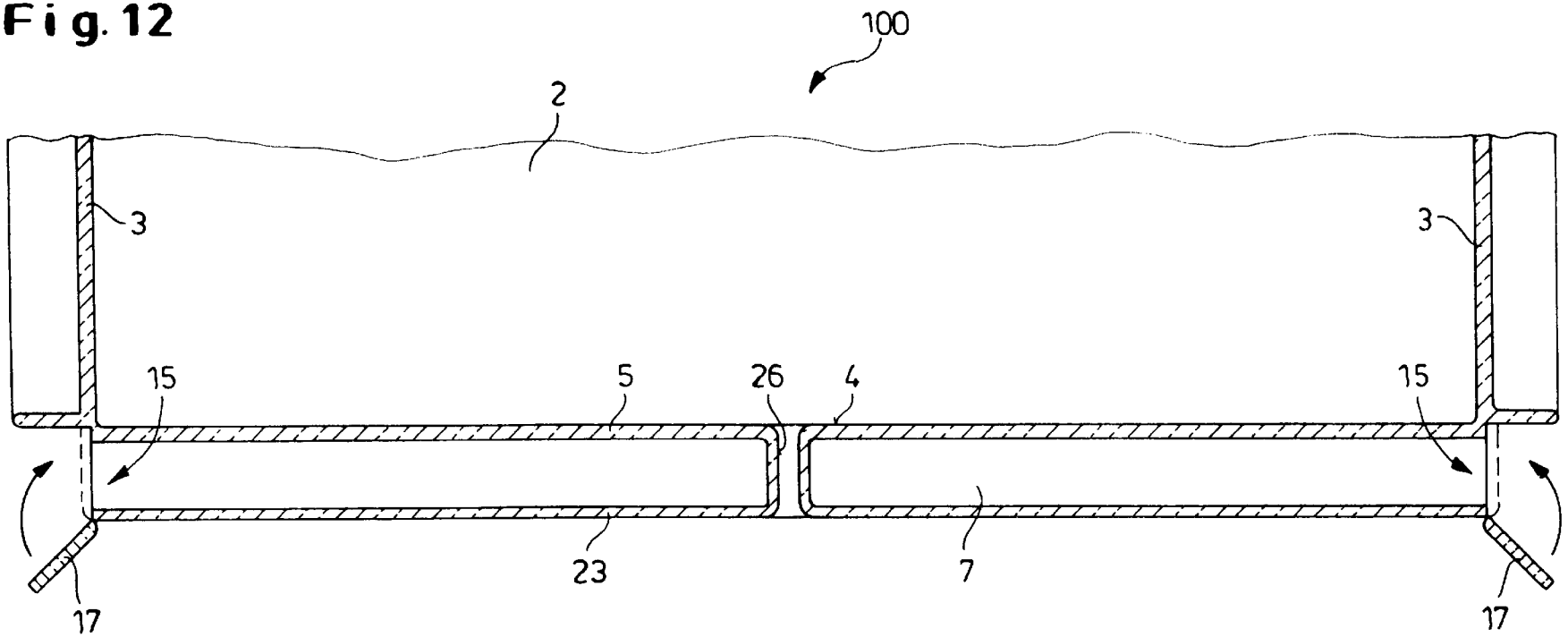
FIG. 12 is a section taken along line XII—XII of FIG. 9.

In FIG. 11 a central region 24 of the lower floor panel 23 is recessed upward, so that in use the container 100 will stand on its floor strips 9*a* and 9*b*.

Figure 13:
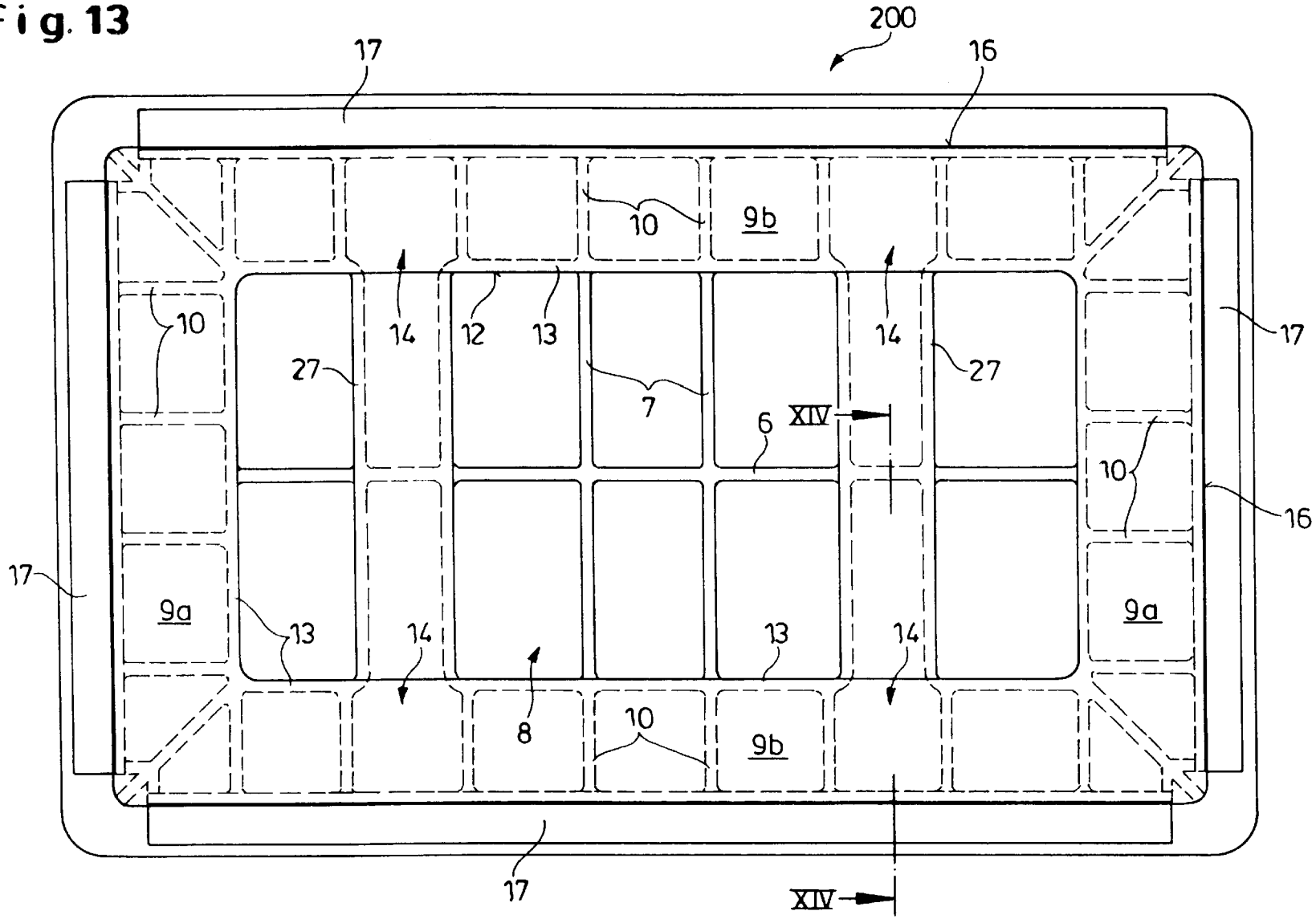
FIG. 13 is a bottom view of a further container according to the invention.
Figure 14:
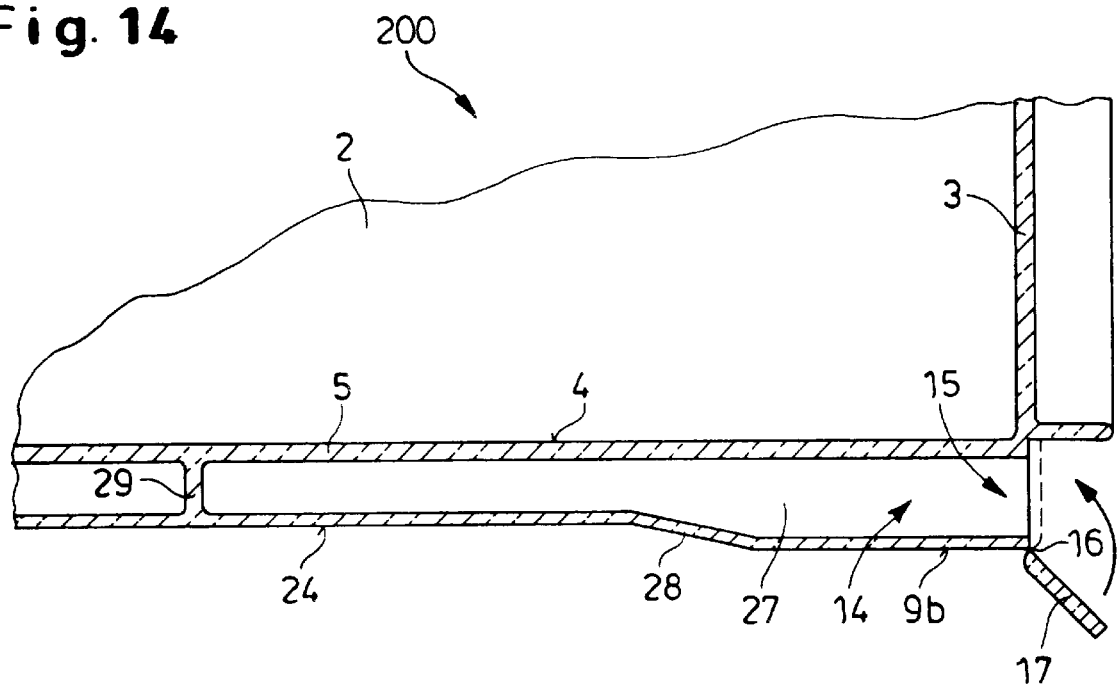
FIG. 14 is a section taken along line XIV—XIV of FIG. 13.
Figure 15:
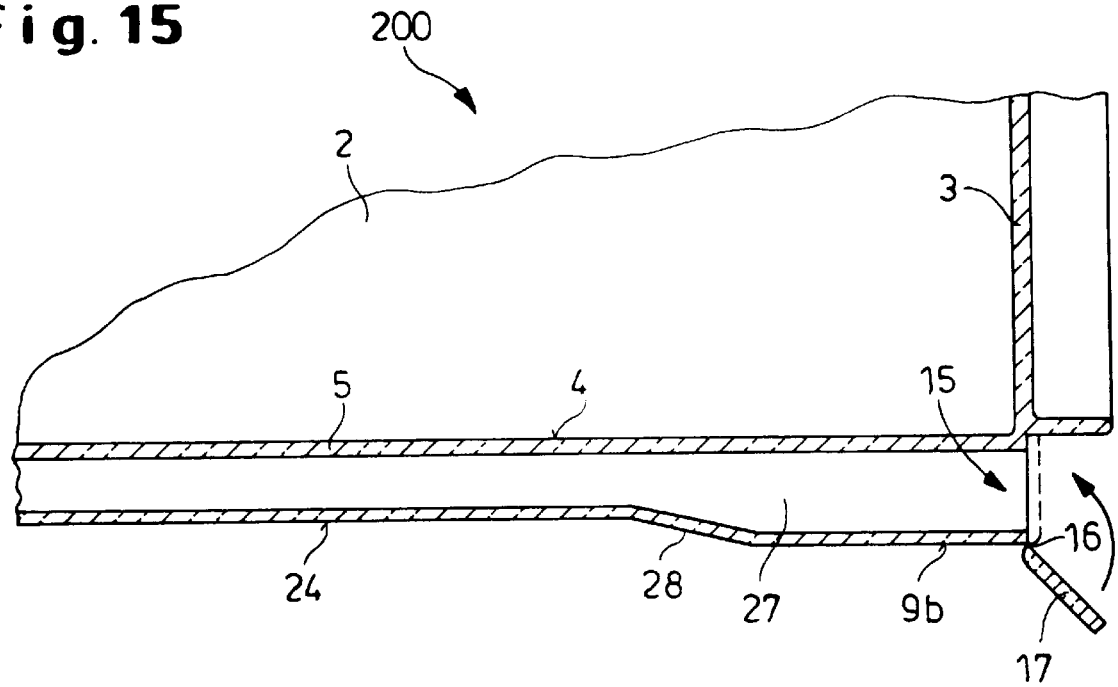
FIG. 15 is a view like FIG. 14 of a variant on the container of FIGS. 13 and 14.

In the container 200 of FIGS. 13 and 14 the center region 8 is largely open as in FIG. 1, but transverse center floor strips 27 are provided in two regions bridging the longitudinal floor strips 9*b*, these center strips 27 being flat and parallel to if not coplanar with the floor strips 9*b*. The inner rib 13 is interrupted at these strips 27 so that the respective pockets extend all the way to the longitudinal central rib 6. These strips 27 thus form with the respective ribs 7 transverse box beams that greatly rigidify the container 200.

I claim:

1. A container comprising:

a polygonal and generally planar upper floor panel having a plurality of edges, an upper face, and a lower face;

respective side walls extending upward from the edges of the floor panel;

an annular array of ribs extending downward from the lower face adjacent the edge;

an annular floor strip generally parallel to and spaced from the panel, fixed to the ribs, and forming therewith an annular array of inwardly closed pockets having horizontally outwardly open directed mouths, the lower face of the upper panel being downwardly exposed inward of the annular array of pockets;

closure strips engaged over all of the mouths and horizontally closing all of the pockets; and means fixing the strips to the mouths of the pockets.

2. The container defined in claim 1 wherein the floor panel, side walls, ribs, and floor strip are unitarily formed of plastic.

3. The container defined in claim 2 wherein the closure strips are unitarily formed of plastic with the floor panel, side walls, ribs, and floor strip and are joined to the floor strip by a unitary hinge for pivoting between a closed position engaged over the respective mouths and closing same and an open position, whereby the container is molded with the closure strips in the open position.

4. The container defined in claim 2 wherein the means is barbed fasteners on the closure strips engageable in the pockets.

5. The container defined in claim 2 wherein the means is welds between the closure strips and the mouths of the pockets.

6. The container defined in claim 5 wherein the mouths have planar rims that fit flush with the closure strips and where the welds are formed.

7. The container defined in claim 6 wherein the rims are formed with weld-holding grooves.

8. The container defined in claim 1 wherein the closure strips and the floor strips meet at an outer edge that is rounded.

9. The container defined in claim 1 wherein the closure strips and the floor strips meet at an outer edge that is beveled.

10. The container defined in claim 1 wherein the ribs include an annular inner rib inwardly closing the pockets and meeting the floor strips at an inner edge that is beveled.

* * * * *